United States Patent [19]

Buser

[11] Patent Number: 4,558,400

[45] Date of Patent: Dec. 10, 1985

[54] PRODUCTION OF LIGHT FROM A FLUORESCENT TUBE WITH REDUCTION OF THE DAZZLING

[76] Inventor: Johann Buser, Ringstrasse 14, 4414 Füllinsdorf, Switzerland

[21] Appl. No.: 537,395

[22] PCT Filed: Jan. 7, 1983

[86] PCT No.: PCT/CH83/00002

§ 371 Date: Sep. 14, 1983

§ 102(e) Date: Sep. 14, 1983

[87] PCT Pub. No.: WO83/02526

PCT Pub. Date: Jul. 21, 1983

[30] Foreign Application Priority Data

| | | | |
|---|---|---|---|
| Jan. 15, 1982 | [AT] | Austria | 130/82 |
| Feb. 4, 1982 | [CH] | Switzerland | 692/82 |
| Sep. 23, 1982 | [CH] | Switzerland | 5611/82 |

[51] Int. Cl.[4] ..... F21M 3/30

[52] U.S. Cl. ..... 362/222; 362/223; 362/299; 362/225; 362/307; 362/311; 362/349; 362/390; 362/440

[58] Field of Search ..... 313/417, 515, 264; 362/217, 222, 225, 216, 223, 299, 307, 311, 349, 390, 440

[56] References Cited

U.S. PATENT DOCUMENTS

| | | | |
|---|---|---|---|
| 2,441,456 | 5/1948 | Thayer | 362/217 X |
| 3,510,645 | 5/1970 | Siegel | 240/51.11 |
| 3,531,687 | 9/1970 | Greber | 313/515 X |
| 4,282,564 | 8/1981 | McJunkin, Jr. et al. | 362/217 |
| 4,425,603 | 1/1984 | Courson | 362/222 |

*Primary Examiner*—Peter A. Nelson

*Attorney, Agent, or Firm*—Brady, O'Boyle & Gates

[57] ABSTRACT

The system for producing non-blinding light from a fluorescent tube comprises a discharge lamp of which the cross-section area has the shape of an equilateral triangle with round edges. Through the invention not only is energy saved, but glaring light is made impossible, thus minimizing dazzling.

9 Claims, 7 Drawing Figures

PRODUCTION OF LIGHT FROM A FLUORESCENT TUBE WITH REDUCTION OF THE DAZZLING

Figure 3:
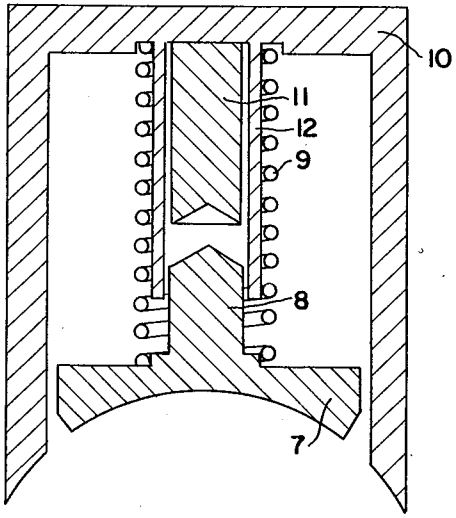

DEFINITION OF THE SYSTEM (a) a profile that is not round but rather triangular with equal areas and rounded edges;
(b) a luminaire with the sockets and mounting devices for the discharge lamp and a reflector;
(c) with sockets adapted to the lamp base for establishing the burning position of the discharge lamp;
(d) an electric circuit for instant ignition of the discharge lamp without stepping up the mains voltage from 220 volts by means of auxiliary ignition anodes built into the potted electrodes of the discharge lamp.

It is well known that fluorescent light dazzles and overloads the iris of the human eye, because it is a line for which the glare factor is much larger than for a point light source. Line light sources have attained enormous importance because of their low mounting height despite the fact that the much greater glare of the line light source brought about an enormous expenditure of energy. To reduce the glare many lamp manufacturers went over to the use of energy-wasting filters.

Through the invention not only is the energy that is wasted in this way saved, but seeing conditions are created that are better than were previously known. The round tube profile is replaced by a triangular profile with rounded edges. This is all the more the case, since this triangular profile can be produced directly on the assembly line, i.e. can be drawn directly from the glass tank in finished form.

By means of mounting the tube with a triangular profile in such a way that the under surface is horizontal and the other two flat surfaces are pointing diagonally upward, a glaring light is made impossible.

Through the installation of a reflector with V-shaped ribbing running across the axis of the lamp and having flanks with an opening angle of 60°–90° inclined planes are formed on the basis of which the reflected light rays cross and are diffused and have the effect of enhancing the three-dimensonal appearance of illuminated objects. To increase the effect, the tooth flanks of the inclined planes are to be made of bare metal, polished, stretched out and anode brightened to attain a uniquely high efficiency.

The equilateral triangle shape used by itself, however, is completely effective only if the rooms that are supposed to be illuminated have ceilings with good reflective characteristics to return the light emitted by the upward-pointing surfaces to the viewer' level economically.

A white ceiling is inadequate if the distance between the tube lamp and the viewer level to be illuminated is too large. The reflective condition of the ceilings and walls, however, also limits the use of the triangular tubes alone.

In case in which the proposed triangular shape used alone is not sufficient to achieve the desired illumination, the new lighting system provides for a combination of liminaire and reflector. According to the invention this reflector is supposed to be designed in such a way that it also precludes so-called reflected glare. This objective is achieved if the reflector base has the appropriate structure. This is accomplished if V-ribs are stamped across the lamp axis to form inclined planes.

A further component of this lighting system is a wiring circuit that makes it possible to produce certain, instant ignition without stepping up the mains voltage from 220 volts.

The invention is described in greater detail with the aid of the illustrations

Figure 2:
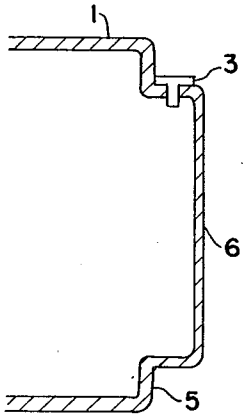
Figure 1:
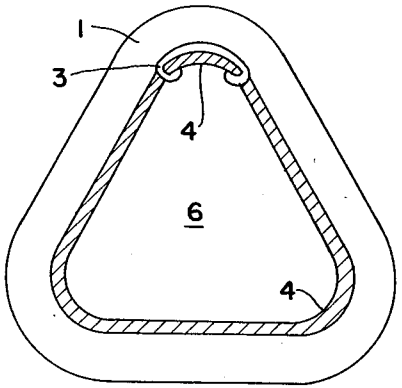
Figure 4:
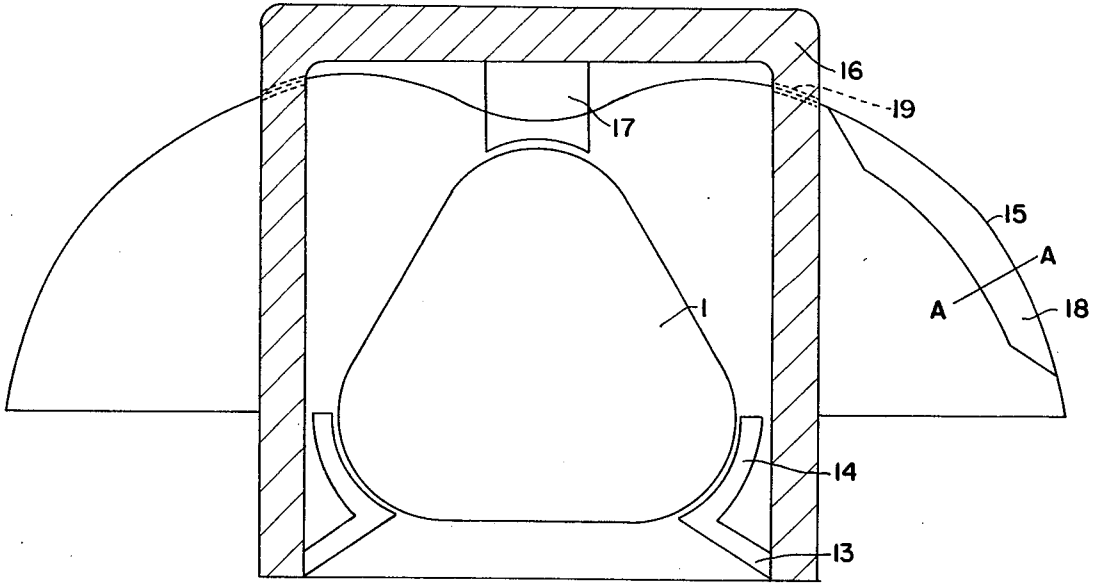
Figure 5:
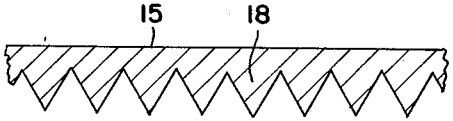
Figure 6:
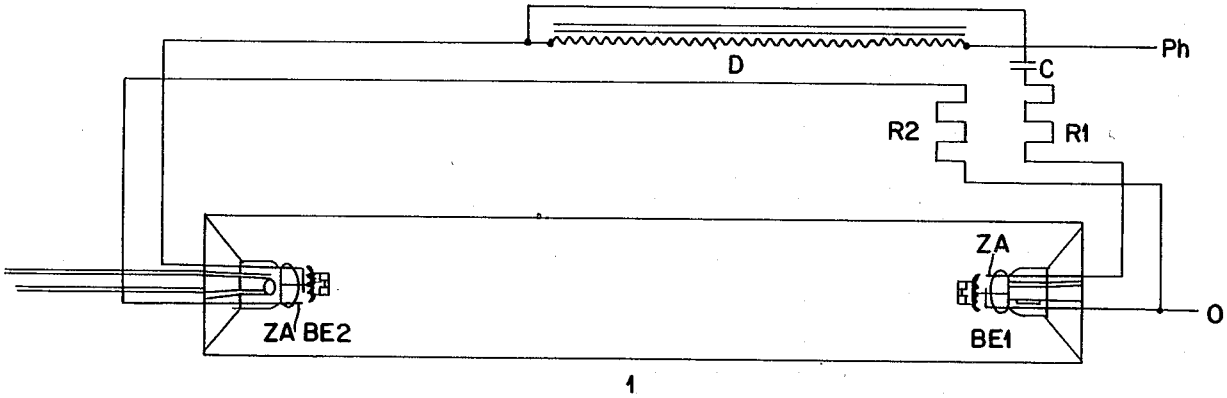

FIG. 1 shows a cross-section through one of the two ends of a discharge lamp, FIG. 2 shows a side view of an endpiece of this discharge lamp in cross-section, FIG. 3 shows a contact device of a socket in cross-section, FIG. 4 shows a cross-section through the luminaire with the discharge lamp and reflector installed, FIG. 5 shows a cross-section through reflector 18 in FIG. 4 A—A of the V-shaped ribs for forming inclined planes, FIG. 6 shows a wiring diagram for the instant ignition and for steady state operation of a discharge lamp by means of ignition voltage without stepping up the line voltage of 220 volts through auxiliary ignition anodes for the potted electrodes ($Be_1$ and $Be_2$).

Figure 6A:
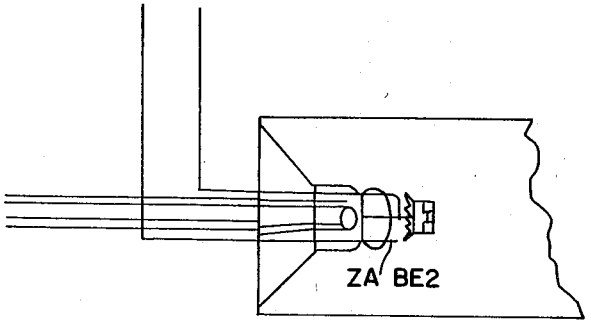

FIG. 6*a* protrays the left end part of the discharge lamp life size and shows the electrode position, especially with the auxiliary anode (ZA).

As one can see from FIG. 1, the discharge lamp 1 is shaped like an equilateral triangle with rounded edges and equal rectangular faces. The bulb of the discharge lamp 1 is sealed heremtically at the ends and fitted with one electrode each, e.g. with deep drawn electrode cups made of steel band with emission points as described in the European application No. 81 890 092.0 that was cited.

At the ends of the lamp bulbs there are also the lamp bases with the contacts 3 for connecting the electrodes to the electric power supply. A contact 3 of this kind is located on at least one of the rounded edges 4. This contact 3 may be set directly on the rounded edge of the bulb. Another possibility, as FIG. 2 shows, consists of setting a cap 6, which also has the form of an equilateral triangle, on the sealing surface 5 of the base of the lamp. It is desirable for this contact (6) to cover and insulate the larger part of the sealing surface involved.

Through providing a special cap 6 in the form of an equilateral triangle it is possible to design the socket and also the corresponding electrical contact device in the socket in a simple manner and nevertheless attain secure retention. In this pocess the discharge lamp 1 is to be inserted into the socket through pressing the bulb sideways, overcoming the spring resistance. In taking the bulb out of the socket the reverse procedure is used.

FIG. 3 shows how the electrical contact device can be arranged in the socket. There is a bent plate 7 here, which can be linked firmly with a guiding cam or a pin 8. A pressure spring 9, which is supported at the other end of a housing 10, grips the plate 7. If the discharge lamp 1 is shoved into the socket, the plate 7 with its pin 8 is pushed against the force of the pressure spring 9 and the pin 8, which forms the opposing contact, is pressed against the solidly housed contact 11. Through this the electrical connection with the power supply is established. To avoid contact with the solidly housed contact 11, an insulating part 12 in which the pin 8 can move is provided.

FIG. 4 shows the socket for the discharge lamp 1 with the socket element 16 cut off. It is advantageous to mount two such elements on a common backing. As can be seen, the contact device 17, which can be constructed as in FIG. 3, is located on the closed side of the element 16. On the open side of the element 16 there are surfaces on two support elements 14. Arms 13 of the support element 14 rest on elements 16 can be arranged so that they swivel. It is also possible to design these arms 13 with springs, so that they always fit well against two of the rounded edges when the discharge lamp 1 is installed. Strictly speaking it is not necessary for both of these arms to be fitted with springs; it is enough if this is the case for one of them and on the other the support surface 14 is designed so that it can swivel. It is then annoying simply to push the discharge lamp 1 into the socket from underneath until its upper rounded edge engages the contact device 17. In this moment the support surfaces then cup the lower rounded edges of the discharge lamp, so that the lamp is held securely. The reflector 15 extends advantageously over the whole length of the discharge lamp 1, with one socket with its elements 17 only on each end of the lamp. The contact devices or lampholders 17 are provided with notches 19 in which the reflector 15 is clamped at opposite ends to stablize it.

In order to avoid indirect reflected glare, it is advantageous if the reflector base is structurally modified, thus, for example, the ribbing 18 can be provided perpendicular to the axis of the lamp. It is enough if the ribbing 18 extends only over a part of the reflector. FIG. 5 shows in section a particularly suitable ribbing pattern, namely V-shaped ribs with an upper angle lying most favorably between 60° and 90°.

The invention is described above with regard to normal room lighting. The lamp according to the invention, however, can be utilized very advantageously in traffic control, both in traffic lights and for directing traffic itself. For traffic lights it is advantageous that now it is no longer point light but rather a linear light source that is being used, through which greater prominence, better recognition of the light color and a larger reception sphere result, because a light line stimulates the visual nerve on a far broader basis and therefore can be preceived much easier and more quickly. In addition there is the fact that the required color can be produced directly with the aid of the illuminating gas used. Thus, for example, through using neon the desired red can be produced, while argon is to be used for green.

For advertising lights the paste electrodes could not be used up to now, because advertising tubes could only be ignited with very high voltages.

Very significant progress has been achieved by designing a circuit for instant ignition of the discharge lamp 1, as is shown schematically in FIG. 6, where the ignition voltage and the operating condition are reached without stepping up the line voltage from 220 volts. Holding down the voltage level for igniting the discharge gap is the consequence of the fact that the bare metal potted electrodes $BE_1+BE_2$ are highly conductive and immediately responsive at low voltage. In view of the small cathode fall of a few volts and the short distance from the auxiliary ignition anodes ZA to the emission points of the main electrodes $BE_1+BE_2$, an electron-producing arc is simply unleashed and instant ignition is initiated already within the first half-cycle.

Through the shunt circuit with the high-impedance resistance $R_1+R_2$ a briefly acting pulsed current surge is produced that immediately brings about the transition from the ignition phase to the steady-state condition.

The shunt circuit that accomplishes ignition can just as well be placed behind the current limiter D and so reduce the size and sensitivity of the high-impedance reisistors still further.

The built-in condensor is more or less optional, since this circuit basically functions without this additional feature, because the sympathetic vibrations are important only if the line voltage dips at the moment of ignition.

The sheet metal of the reflector (15) should be made of plated aluminum sheet, the base material consisting of a purity of at least 99.95% and the plating of the reflector layer being of a purity of 99.99% (Reflektal or Raffinal).

I claim:

1. A fluorescent lighting fixture for producing nonglaring light, comprising an elongated fluorescent tube of triangular cross-section having three substantially flat elongated side surfaces, a mounting plane for the fixture, means for holding the opposite end regions of the fluorescent tube for mounting said fluorescent tube to said mounting plane, said means for holding positioning one of said three substantially flat elongated side surfaces of said fluorescent tube substantially parallel to said mounting plane for the fixture and directed away from said mounting plane, elongated reflecting means connected between said mounting plane and said elongated fluorescent tube, said elongated reflecting means including two light reflecting inside surfaces curved longitudinally symmetrically about a longitudinal axis parallel with the axis of said elongated fluorescent tube to reflect part of the light radiated by the fluorescent tube, the other two of said three substantially flat elongated side surfaces conveying toward each other toward said elongated reflector means and substantially facing said two light reflecting inside surfaces whereby the light radiated from said other two flat side surfaces is reflected substantially in the same direction as the light radiated from the said one flat side surface, and means on said two light reflecting inside surfaces for lessening the glare effect of the reflected light.

2. A fluorescent lighting fixture according to claim 1, in which said means for holding the opposite end regions of the fluorescent tube comprise two socket elements (16) spaced from one another on said mounting plane at opposite ends of said fluorescent tube, each socket element comprising a rectangular parallepiped-shaped housing having two open sides, one of which is directed away from the mounting plane and the other of which is directed toward the opposite housing, and means disposed in each of said housings for supporting a respective one of the end regions of said fluorescent tube.

3. A fluorescent lighting fixture according to claim 2, in which said means for supporting comprise a spacing element (17) and two support elements (14), said spacing element (17) disposed substantially medial of the wall of the housing facing the mounting plane, and one each of the two support elements (14) is disposed on the inside of the opposing sidewalls of the housing adjacent opposite longitudinal edges of said one of said substantially flat elongated side surface of said fluorescent tube.

4. A fluorescent lighting fixture according to claim 3, in which said spacing element (17) includes a first (11) contact piece and a second (8) contact piece axially spaced from said first contact piece (11), said first contact piece (11) connected rigidly to the spacing element (17), a tubular insulating member (12) connected to said spacing element (17) in surrounding relation to said first contact piece (11), a compression spring (9) connected coaxial with and around the outside of the insulating member, said second contact piece (8) connected to the outer end of said compression spring (9) and displaceable in the insulating member against the bias of said compression spring, whereby when said fluorescent tube is inserted it contacts said second contact piece (8) and moves it into electrical contact with said first contact piece (11) for the purpose of the passage of current.

5. A fluorescent lighting fixture according to claim 3, in which at least one of the support elements (14) is a spring arm for facilitating the insertion of said fluorescent tube.

6. A fluorescent lighting fixture according to claim 2, including notches (19) in the opposed sidewalls of said housing (16) which face each other, opposite ends of said reflecting means connected in said notches.

7. A fluorescent lighting fixture according to claim 1, in which said means on said two light reflecting inside surfaces of the reflecting means include V-shaped ribs disposed at right angles to the longitudinal direction thereof.

8. A fluorescent lighting fixture according to claim 7, in which the V-shaped ribs have an aperture angle in the range of 60°-90°.

9. A fluorescent lighting fixture according to claim 7, in which said reflecting means is constructed of plated sheet aluminum, the reflecting plated inside layer having a purity of at least 99.99%.

* * * * *